US006361005B1

(12) United States Patent
Faisst et al.

(10) Patent No.: US 6,361,005 B1
(45) Date of Patent: Mar. 26, 2002

(54) HOLDING DEVICE FOR A HAND-OPERATED SHOWER HEAD

(75) Inventors: Magdelena Faisst, Schiltach; Andreas Haug; Thomas Schoenherr, both of Stuttgart, all of (DE); Thomas Kuechler, Zell am See (AT); Fabian Kollmann, Leonberg (DE)

(73) Assignee: Hansgrohe AG, Schiltach (DE)

( * ) Notice: Subject to any disclaimer, the term of this patent is extended or adjusted under 35 U.S.C. 154(b) by 0 days.

(21) Appl. No.: 09/450,908

(22) Filed: Nov. 29, 1999

(30) Foreign Application Priority Data

Nov. 27, 1998 (DE) ..... 198 54 791

(51) Int. Cl.[7] ..... A47B 96/06

(52) U.S. Cl. ..... 248/219.4; 248/222.51; 248/220.21; 248/218.4

(58) Field of Search ..... 239/273, 283, 239/282; 248/218.4, 219.4, 220.21, 220.22, 222.51, 222.52, 291.1, 309.1

(56) References Cited

U.S. PATENT DOCUMENTS

| | | | | | |
|---|---|---|---|---|---|
| 3,979,096 | A | | 9/1976 | Zieger | 248/75 |
| 4,174,822 | A | | 11/1979 | Larsson | 248/75 |
| 4,719,654 | A | * | 1/1988 | Blessing | 4/597 |
| 5,265,833 | A | * | 11/1993 | Heimann et al. | 248/75 |
| 5,318,263 | A | * | 6/1994 | Bischoff et al. | 248/220.22 |
| 5,632,049 | A | | 5/1997 | Chen | 4/570 |
| 5,704,080 | A | * | 1/1998 | Kuhne | 4/605 |
| 5,857,225 | A | * | 1/1999 | Bischoff et al. | 4/605 |
| 6,024,331 | A | * | 2/2000 | Bischoff et al. | 248/229.1 |

FOREIGN PATENT DOCUMENTS

| | | |
|---|---|---|
| DE | 35 06 121 A1 * | 8/1986 |
| DE | 35 39 517 | 1/1987 |
| DE | GM 87 03 949.4 | 8/1987 |
| DE | 37 01 095 | 7/1988 |
| DE | GM 91 01 861.7 | 9/1991 |
| DE | 41 06 878 | 9/1992 |
| DE | 94 01 166.4 | 5/1994 |
| WO | WO 98/14098 | 4/1998 |

* cited by examiner

*Primary Examiner*—Ramon O Ramirez
*Assistant Examiner*—Holly N. Sy
(74) *Attorney, Agent, or Firm*—Duane, Morris, LLP

(57) ABSTRACT

A holding device for a hand-operated shower head contains a body, which is e.g. constructed as a slide for a wall rod and is held in longitudinally slidable manner on the wall rod. In its front it contains an adjusting screw for adjusting the force with which a brake mechanism acts on the wall rod.

A reception element is articulated to the body so as to be pivotable about an axis upstream of the wall rod. The reception element receives part of the handle of a shower head, so as to fix the latter. The shower head can be pivoted in such a way that the median axis of the cone nut inserted in the receptacle is moved in a plane in which the longitudinal axis of the wall rod is also located.

16 Claims, 3 Drawing Sheets

HOLDING DEVICE FOR A HAND-OPERATED SHOWER HEAD

BACKGROUND OF THE INVENTION

It is known that hand-operated shower heads are fixed e.g. to vertically directed wall rods with the aid of a slide. The slide makes it possible to frequently change the inclination of the hand-operated shower head, i.e. the angle between the grip or handle and the wall rod axis. The pivot axis is then positioned laterally of the wall rod, so that for pivoting purposes the hand-operated shower head is positioned to the right or left of the wall rod.

The problem of the invention is to provide a holding or retaining device for a hand-operated shower head, which provides use advantages and which has a particularly pleasing appearance.

SUMMARY OF THE INVENTION

For solving this problem the invention proposes a holding device for a hand-operated shower head having the features of claim 1. Further developments of the invention form the subject matter of dependent claims, whose wording, like that of the abstract, is made by reference into part of the content of the description. The body is used for fitting the holding device e.g. to a wall, bracket, wall rod, etc. The reception element is pivotable relative to the body. As the reception element has a receptacle for the hand-operated shower head, the latter can in this way be pivoted with respect to the body and therefore the wall rod.

The symmetrical arrangement of the mounting support of the reception element makes it possible to position the hand-operated shower head closer to the plane of symmetry, which is in accordance with the esthetic ideas of the user.

According to a further development of the invention the pivoting axis is materialized by a shaft, which is constructed symmetrically to a median plane, particularly symmetrically to a median plane of the body.

According to a further development it is obviously advantageous for not only the mounting support to be symmetrical, but also the complete arrangement constituted by the body and the pivotable reception element, the symmetry also being extendible to the arrangement relative to the wall rod.

According to the invention, the body is positioned in the vicinity of a component projecting over the surface of a wall and the axis is positioned upstream of said component.

For example, the body can be fixed to a wall connecting bend or even form part of the latter. Wall connecting bends are known and serve to connect a shower hose to an indoor installation close to the wall surface. The fitting of the body is appropriate.

Another possibility proposed by the invention is to fix the body to a wall rod, such is of a conventional nature in shower cubicles or bath tubs. These wall rods are also used for fixing other sanitary elements. According to another further development of the invention, the body is constructed as a slide or can be connected to a slide.

According to a further development, on pivoting the reception element the axis of the receptacle for the hand-operated shower head remains in a plane which, from the plane in which the longitudinal axis of the wall rod is located, at the most has a spacing which is a maximum of half as large as half the transverse extension of the wall rod. Thus, a symmetrical arrangement is maintained even on pivoting. It is naturally also possible that the plane in which the axis of the receptacle for the hand-operated shower heads remains, also forms the plane in which the longitudinal axis of the wall rod is located.

On fitting the holding device to a wall rod, according to the invention the pivoting axis can be upstream of the wall rod.

According to a further development of the invention, the holding device has a guard for the shower hose, so that there is no excessive bending of the latter in the case of pivoting. The guard can be in the form of a curved element between the receptacle for the hand-operated shower head and the pivoting axis.

According to a further development of the invention, a limiting means, e.g. in the form of a stop is provided for the pivoting movement of the reception element.

The invention proposes that the reception element is constructed in such a way that it at least partly covers the body, particularly the mounting support between the body and the reception element.

If it is constructed as a slide for a wall rod, the body can have a brake mechanism, which can be adjusted by an adjusting device, e.g. with the aid of a screw. The reception element can cover the adjusting device, e.g. the screw.

The reception element can e.g. receive the hand-operated shower head in such a way that it has a receptacle with a conical sleeve for the shower head handle. This conical sleeve preferably has a very small cone angle, so that the hand-operated shower head can be fixed there without further measures. It is also possible for the conical sleeve to be slotted, e.g. at one point, so as to permit a certain resilient deflection as a result of this. The slot can also be used for the lateral insertion of the shower hose.

According to a further development, part of the conical sleeve is formed by an insert, which is freely radially movable with respect to the remainder of the conical sleeve. For example, the insert can have a resilient construction.

As a result of the resilient construction a reinforced, improved fixing of the handle can be achieved. In particular, the insert can have in the vicinity of its end associated with the sleeve end an inwardly directed projection with which it can engage on a shoulder of the handle.

BRIEF DESCRIPTION OF THE DRAWINGS

Further features, details and advantages of the invention can be gathered from the following description of a preferred embodiment of the invention and the attached drawings, wherein show.

DETAILED DESCRIPTION OF THE PREFERRED EMBODIMENT

Figure 1:
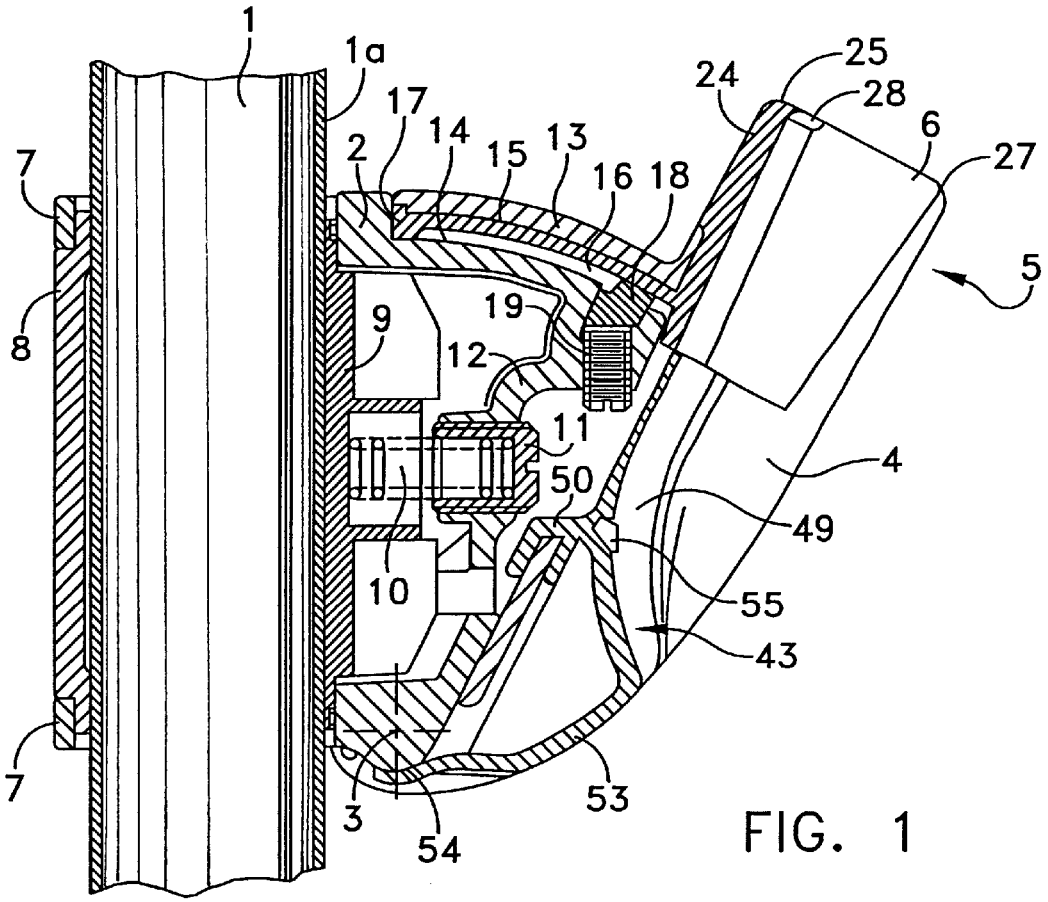
FIG. 1 A section through a holding device in a plane containing the longitudinal axis of a wall rod.

In FIG. 1 a section is drawn through a wall rod 1. In the represented embodiment the wall rod 1 is not given a circular cylindrical shape. To the wall rod is fixed in longitudinally slidable manner a holding or retaining device for a hand-operated shower head. The holding device contains a body 2, which envelops the wall rod 1 and in the vicinity of its lower end forms an axis for a reception element 4 positioned upstream of the wall rod 1. The reception element is articulated to the body 2 so as to be pivotable about the axis 3. The reception element 4 contains a receptacle 5 for part of a handle of a hand-operated shower head. This receptacle contains a conical sleeve 6, in which can be inserted the handle of the hand-operated shower head. The body 2 has two ring elements 7, which surround with a certain spacing the wall rod 1. Between the ring element 7 is inserted on the back remote from the reception element 4 an approximately U-shaped brake shoe 8, which in the area of its upper and lower end engages on the outside of the wall rod 1. On the opposite side a pressure plate 9 is inserted in the body 2 and is pressed by a spring 10 against the front 1*a* of the wall rod 1. The spring 10 extends between the pressure plate 9 and an adjusting screw 11 inserted in the front wall 12 of the body 2. By adjusting the adjusting screw 11 the tension of the spring 10 and consequently the contact pressure of the pressure plate 9 can be regulated. The pressure plate 9 serves to keep the body 2 in its set position on the wall rod 1, but also to permit the longitudinal sliding thereof.

As has already been stated, the reception element 4 is pivotable about the axis 3. During pivoting an upper, arcuate cover 13 of the reception element 4 moves over the top of the body 2 and serves to cover from above said body 2. Between the cover 13 and the top 14 of the body is formed an intermediate space in which is located a tongue 15 connected to the reception element 4. The tongue 15 tightly engages on the underside of the cover 13. Between the underside of the tongue 15 and the top 14 of the body 2 is formed a gap 16 in which slides a projection 17. On completely pivoting the reception element 4 the projection 17 engages on a brake shoe 18, which with the aid of a screw 19 is brought against the underside of the tongue 15. The material and/or surface characteristics of the brake shoe 18 and tongue 15 are so matched to one another that an easy, jerk-free braking is achieved.

Figure 2:
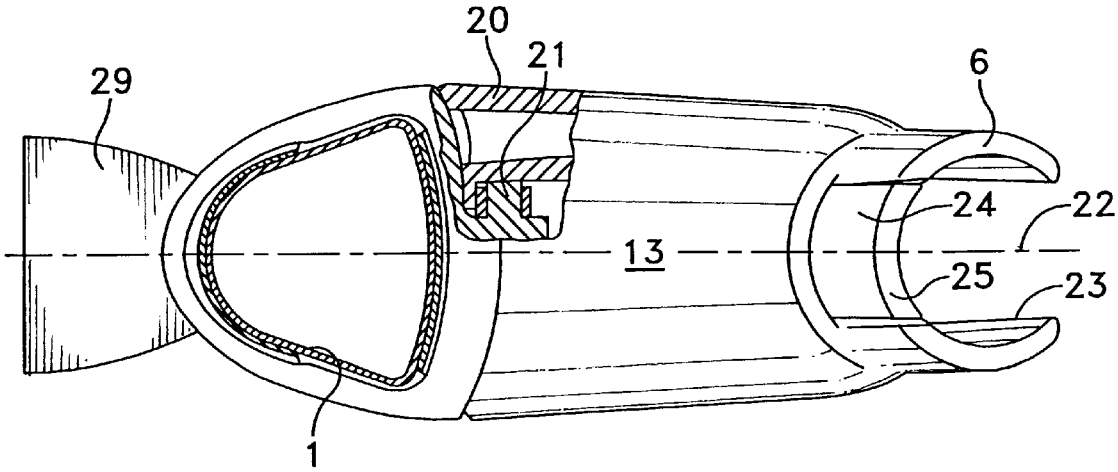
FIG. 2 A part sectional plan view of the arrangement of FIG. 1.

As is apparent from the plan view of FIG. 2, the reception element 4 has two side walls 20, which enclose between them from both sides and therefore cover the body 2.

From the sectional part of FIG. 2 it can be seen that the pivoting axis 3 is materialized by a shaft 21, which is constructed symmetrically to a median plane 22 of the device.

On its front side remote from the wall rod 1, the conical sleeve 6 has a wise slot 23 through which can be laterally inserted the shower hose. On the opposite side facing the wall rod 1 the conical sleeve 6 also contains a slot, in which is inserted an arcuate insert 24, which almost completely fills this slot. The already mentioned tongue 15 is shaped in one piece onto the outside of the insert 24. The insert 24 can be made from a different material to the reception element 4, or can be given a somewhat different shape, so that it exerts a certain action on the part of the handle of the hand-operated shower head inserted in the conical sleeve 6. In the vicinity of the upper end 25, i.e. that end of the insert 24 associated with the outer end 27 of the conical sleeve 6, the insert 24 has a small, inwardly directed projection 28. The latter can engage behind a shoulder of the cone nut with which the shower hose is screwed firmly to the shower head handle.

Figure 3:
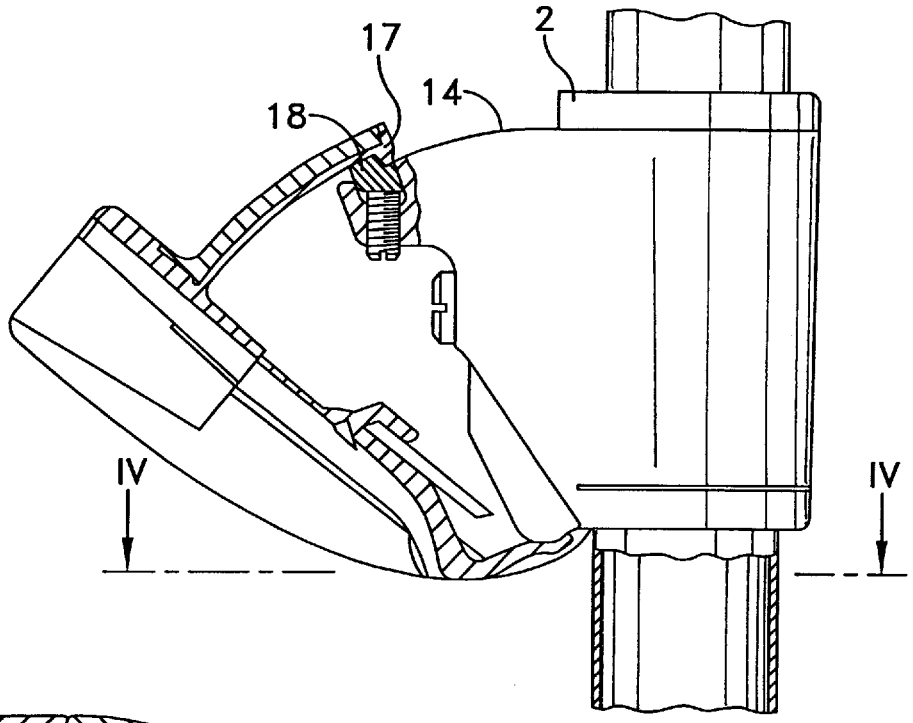
FIG. 3 A side view of the holding device in the case of a pivoted reception element.

It can also be gathered from FIG. 2 that the wall rod 1 is fixable with the aid of a bracket 29 so as to be spaced from a wall. FIG. 3 shows the holding device from the opposite side in the maximum pivoted state. On pivoting the projection 17 slides on the in side view arcuate top 14 of the body 2 until it engages on the brake show 18. Also in this completely swung-out position the front of the body, in which the adjusting screw 11 is located, is still completely covered by the side walls 20 of the reception element 4.

Figure 4:
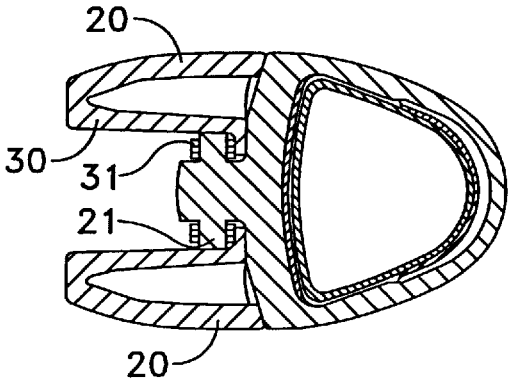
FIG. 4 A section along line IV–IV in FIG. 3.

FIG. 4 is a section roughly along line IV–IV in FIG. 3 with the holding device in the swung-in position. The walls 20 are in double-walled form and on the inner portions 30 are located the receptacles 31 for the ends of the shaft 21.

Figure 5:
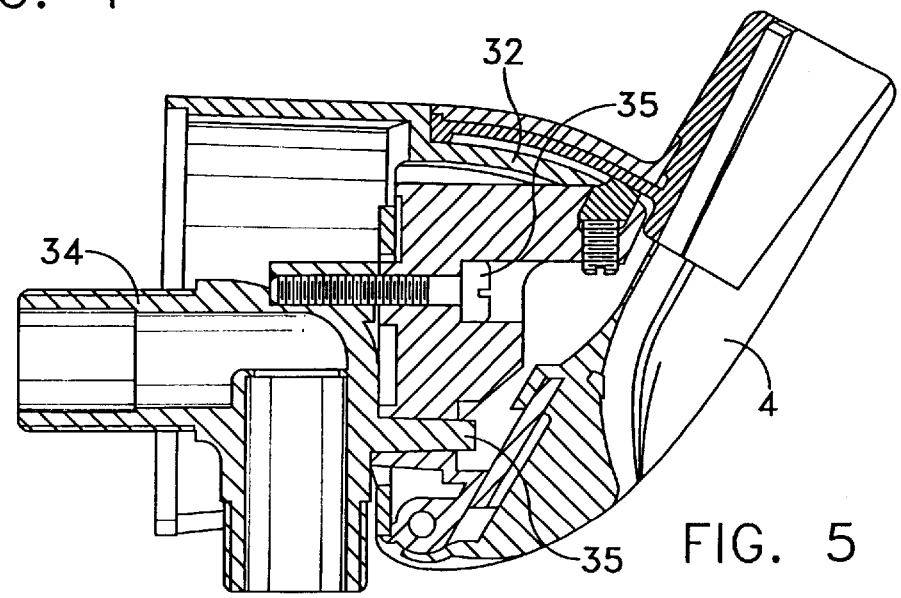
FIG. 5 A section corresponding to FIG. 1 for a second embodiment.

FIG. 5 shows a section corresponding to FIG. 1 through a second embodiment of the holding device, in which the reception element 4 is identical. In this embodiment the body 32 is constructed in such a way that it can be screwed with a screw 33 or two successive screws 33 to a wall connecting bend 34, which contains a spigot 35, which passes through a corresponding opening of the body 32. The remaining parts of the arrangement correspond to those of the embodiment according to the previous drawings.

Figure 6:
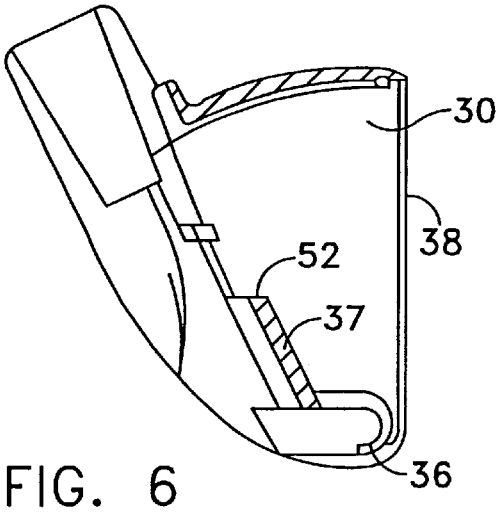
FIG. 6 A section through a reception element.

FIG. 6 shows a section solely through the reception element 4. On the visible, inner portions 30 of side walls 20 are U-shaped ribs 36, which form the receptacles 31 for the ends of the shaft 21. The inner walls 30 are interconnected by a front wall 37. The rear edges 38 of side walls 20 or inner walls 30 are so dimensioned that, in the swung-out position according to FIG. 3, the front of the body is still covered.

Figure 7:
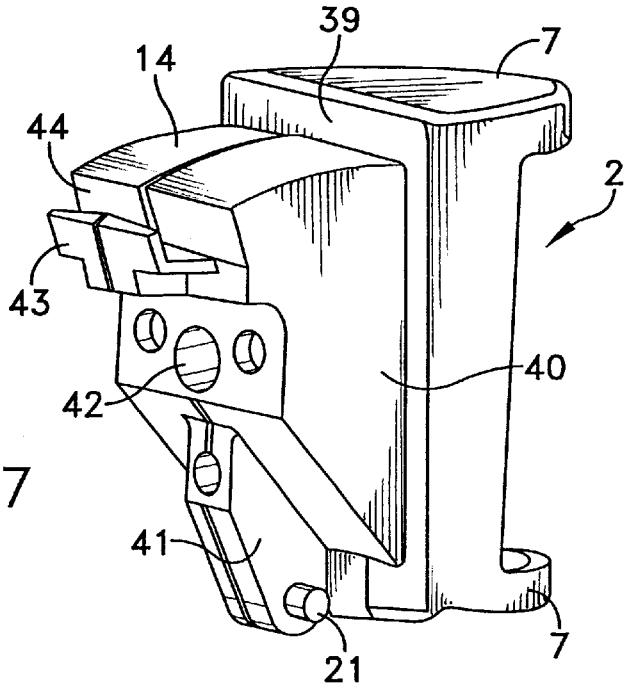
FIG. 7 A perspective view of a body for fitting to a wall rod.

The body 2 is shown perspectively in FIG. 7. The body 2 contains a frame-like front wall 39 with an opening in which is located the pressure plate 9, cf. FIG. 1. From the frame-like front wall 39 extend two parallel side walls 40 and which are connected at the top by the top 14. Below the side walls 40 is formed a front lug 41 from which the ends of the shaft 21 project to either side. Roughly in the center is provided the opening 42 for the clamping screw 11. Below said opening and upstream of the top 40 an angle 43 forms a groove 44 for the brake show 18.

Figure 8:
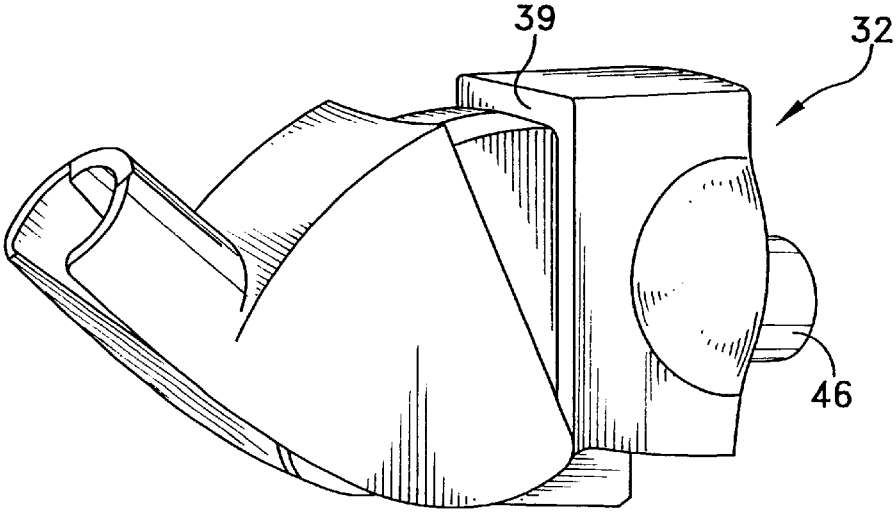
FIG. 8 Perspectively the arrangement of FIG. 5 in the pivoted up state.

FIG. 8 perspectively shows the embodiment of FIG. 5 in the swung-out state. From its front 39 towards the front, i.e. in FIG. 8 towards the left front, the body 32 has an identical or almost identical construction to the body 2 of FIG. 7. The front wall 39 bounds a roughly parallelepipedic member, from whose rear projects the connecting piece 46. Also in the embodiment of FIG. 8 the mounting support is constructed symmetrically to a median plane of the body 32.

In order to protect the connecting area of the shower hose on pivoting the reception element, the latter has a guard 48 for this area of the hose. The guard 48 contains an arcuate, channel-like front wall 49 directed in such a way that the hose is concavely curved. On the back facing the wall rod 1 is shaped a hook 50 with which the guard 48 can be mounted on the upper edge 52 of the front wall 37 of the reception element 4. Said upper edge can e.g. be seen in FIG. 6. To the channel-like front wall 49 is connected a base part 53, whose free end 54 engages resiliently on the underside of the projection 41 of body 2 or 32. As a result of the pretensioning of this free end 54 the guard 48 is held in the position shown. Through its front wall 49 the guard 48 also covers the access to the front of the body 2. It contains a notch 55 in which can be inserted a tool, e.g. a screwdriver. By upwardly sliding counter to the action of the resilient end 54, the guard 48 can be released and removed from the front wall 37. In this state the clamping screw 11 can be operated, as can the screw 19 acting on the brake shoe 18.

What is claimed is:

1. A holding device for a hand-operated shower head, comprising a body for the fitting of the holding device to an object, a reception element for the hand-operated shower head, the reception element having a mounting support, wherein the reception element is pivotably mounted on the body and has a receptacle for part of the hand-operated shower head, in which the mounting support of the reception element is constructed symmetrically to the body and, wherein the mounting support is implemented by a shaft constructed symmetrically to a median plane of the body.

2. Holding device according to claim 1, wherein the body is located in the area of a component projecting over the surface of a wall and the receptacle has an axis that is located upstream of the component.

3. Holding device according to claim 1, wherein the body can be fixed to a wall connecting bend.

4. Holding device according to claim 1, wherein the body is fixable to a wall rod.

5. Holding device according to claim 4, wherein the body is constructed as a slide.

6. Holding device according to claim 4, wherein when said holding device is fixed to the wall rod, on pivoting the reception element, the axis of the receptacle remains in a plane which has a maximum spacing from a plane in which is located a longitudinal axis of the wall rod which is at the most half the transverse extension of the wall rod.

7. Holding device according to claim 4, wherein the receptacle is pivotable about a pivoting axis positionable upstream of the wall rod.

8. Holding device according to claim 1, having a guard for a shower hose positioned between the receptacle for the hand-operated shower head and the pivoting axis.

9. Holding device according to claim 1, having a means for limiting the pivoting movement of the reception element.

10. Holding device according to claim 1, wherein the reception element at least partly covers the mounting support.

11. Holding device according to claim 1 further comprising a brake mechanism including an adjusting device for adjusting the holding force of the brake mechanism, wherein said adjusting device is covered by the reception element.

12. Holding device according to claim 11, wherein the reception element has a removable cover, for accessing the adjusting device for the brake mechanism.

13. Holding device according to claim 1, wherein the receptacle has a conical sleeve.

14. Holding device according to claim 13, wherein the part of the conical sleeve is formed by an arcuate insert, which is radially freely movable with respect to the remainder of the conical sleeve.

15. Holding device according to claim 14, wherein the arcuate insert has a resilient construction.

16. Holding device according to claim 14, wherein the arcuate insert has an inwardly directed projection near an axial end of maximum diameter.

* * * * *